US005681272A

United States Patent [19]

Lee

[11] Patent Number: 5,681,272

[45] Date of Patent: Oct. 28, 1997

[54] PORTABLE TRACTION DEVICE

[76] Inventor: James M. Lee, 351 Warwick Ave., South Orange, N.J. 07079

[21] Appl. No.: 448,678

[22] Filed: May 24, 1995

[51] Int. Cl.[6] ..... A61H 1/02

[52] U.S. Cl. ..... 602/32; 602/33

[58] Field of Search ..... 602/32–40; 482/61; 606/237, 241–245; 5/646, 648, 649–651

[56] References Cited

U.S. PATENT DOCUMENTS

| | | | |
|---|---|---|---|
| 72,515 | 12/1867 | McClelland . | |
| 3,176,684 | 4/1965 | Walsh . | |
| 3,276,444 | 10/1966 | Rice . | |
| 3,298,364 | 1/1967 | Radford | 602/33 |
| 4,595,194 | 6/1986 | Previtali | 482/61 |
| 4,606,333 | 8/1986 | Graham . | |
| 4,643,173 | 2/1987 | Bell et al. . | |
| 4,877,044 | 10/1989 | Cantwell et al. | 135/127 |
| 5,217,488 | 6/1993 | Wu . | |

FOREIGN PATENT DOCUMENTS

88/10107 12/1988 WIPO .

*Primary Examiner*—Richard J. Apley
*Assistant Examiner*—Kim M. Lee
*Attorney, Agent, or Firm*—Jacobson, Price, Holman & Stern, PLLC

[57] ABSTRACT

A portable traction device primarily for application of pelvic traction can be easily transported, assembled and dismantled by a user for the self-application of traction without the need for specialized in-patient equipment. The device is carried in a padded storage bag and includes a foldable traction frame assembly on which the user lies during application of traction. Also included are a pelvic belt, traction cords and water bags to be attached to the belt as well as hip and neck support cushions, all of the components being receivable in the storage bag. The user carries the bag and sets up the device at any convenient location. A primary component of the device is a foldable frame assembly having a base plate on which the user lies during treatment and a frame at one end providing elevated cord guides over which the traction cords extend from the belt to the water bags.

13 Claims, 6 Drawing Sheets

PORTABLE TRACTION DEVICE

BACKGROUND OF THE INVENTION

This invention relates to a portable traction device particularly suitable for self-use to apply pelvic traction in the treatment of lower back ailments, but which can also be used for application of traction to other areas, for example for the application of neck traction.

The application of pelvic traction is a well-known prescribed treatment for various lower back ailments. Typically, such traction is applied with the patient, wearing a pelvic belt, lying on his or her back on a bed, by attaching weights such as water or sand bags to the belt through cords that are wound over pulleys or the like. Some type of frame structure is needed to support the pulleys in position, usually at the foot of the bed, so that tractive force is applied to the patient in a suitable direction through the weights, cords and belt.

Pelvic traction systems which are in current use tend to be restricted to hospital bed attachments and little effort appears to have been expended in the development of truly portable, self-assembly type systems which can be used in the home or when travelling.

SUMMARY OF THE INVENTION

It is an objection of this invention to provide a portable traction device which can be readily transported and set up single-handedly by a user for the self application of pelvic or other traction in any suitable location.

Another object of the invention is to provide a portable traction device as above which does not necessarily need to be used on a bed, but where the user can lie on any convenient support surface, for example a bedroom or other floor.

Yet another object of the invention is to provide a portable traction device as above which can be dismantled and packed in a convenient carrying bag for transportation.

To fulfill the above and other objects, the invention provides, at least in a preferred embodiment, a portable traction device having as a basic element a folding traction frame assembly comprising a base (or back) plate to be placed flat on a suitable support surface such as a floor or carpet and on which a user can lie so that the structure is stabilized by the user's weight itself, and a support frame at one end of the base plate which can be elevated relative to the base plate to provide a support structure for a pair of spaced cords each to be attached at one end to a pelvic belt worn by the user and at the other end to a weight preferably in the form of a water bag.

The support frame is preferably pivoted to the base plate so that it can be folded flat for transportation and can be raised and releasably locked in an upright position for use.

A padded storage and carrying bag may be provided for carrying the base plate/support frame assembly, along with the pelvic belt, the cords and the water bags. The storage bag may be used on the base plate to form a padded sheet on which the user can lie while applying traction and loop and pile-type fasteners may be provided on the bag and on the base plate to properly position same. The support frame may be provided with a collapsible upper cross-bar assembly providing cord pulleys at its opposite ends, and a collapsible lower cross-bar assembly providing foot rests for the user. The padded bag may also include removable neck and hip cushions to enhance user comfort during the application of traction.

All of the components of the device can be easily removed from the storage bag and set up single-handedly by the user.

Similarly they can be readily dismantled and replaced in the storage bag after use.

Additional features and advantages of the invention will become apparent from the ensuing description and claims read in conjunction with the attached drawings.

DETAILED DESCRIPTION OF THE PREFERRED EMBODIMENTS

Figure 3:
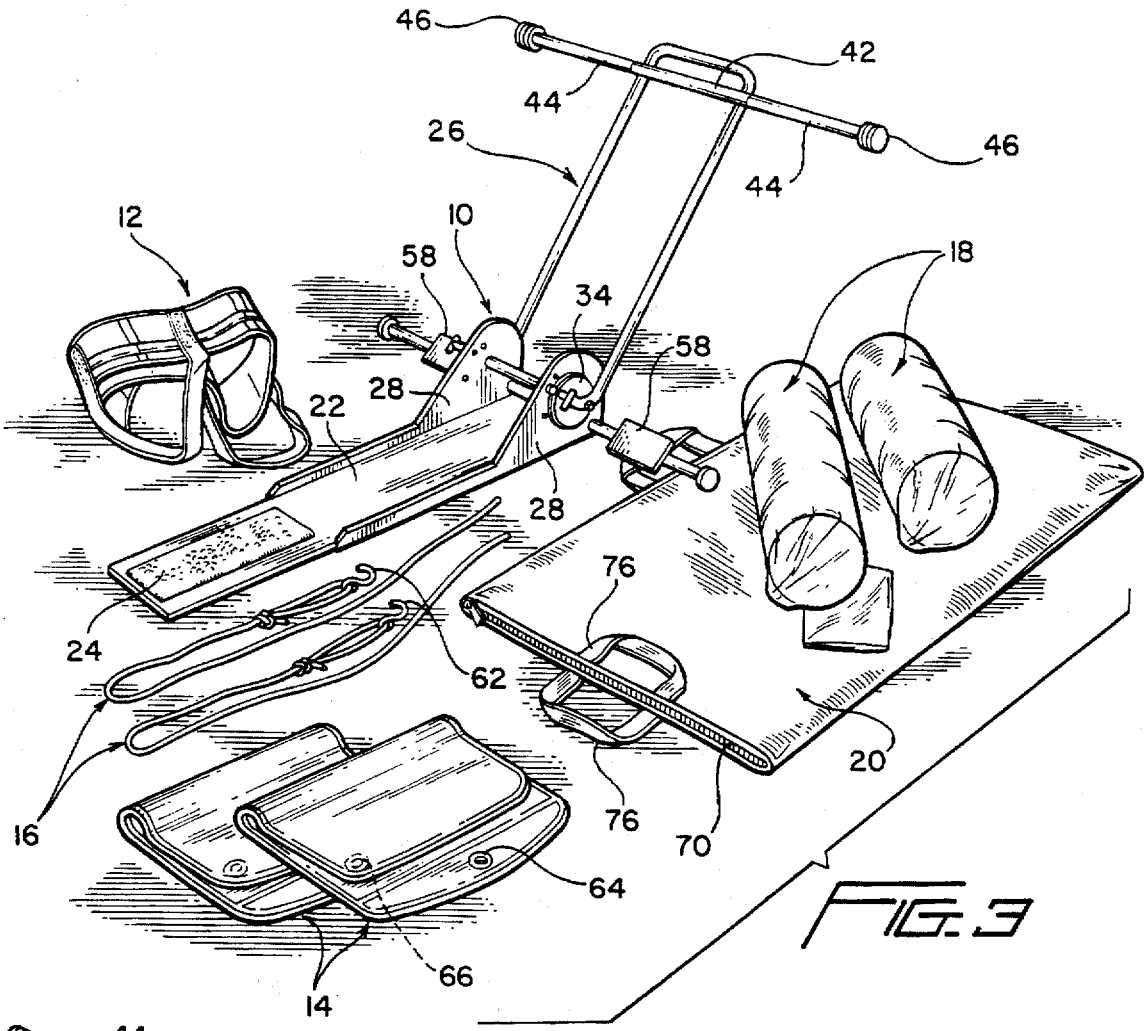
FIG. 3 is an exploded perspective view showing the components removed from the bag in preparation for use.

As best seen in FIG. 3, for example, a portable traction device according to the invention comprises a traction frame assembly 10, a traction belt 12, a pair of water bags 14, cords 16 and neck and hip cushions 18, all of which fit in a padded zip-up carrying bag 20.

Figure 10:
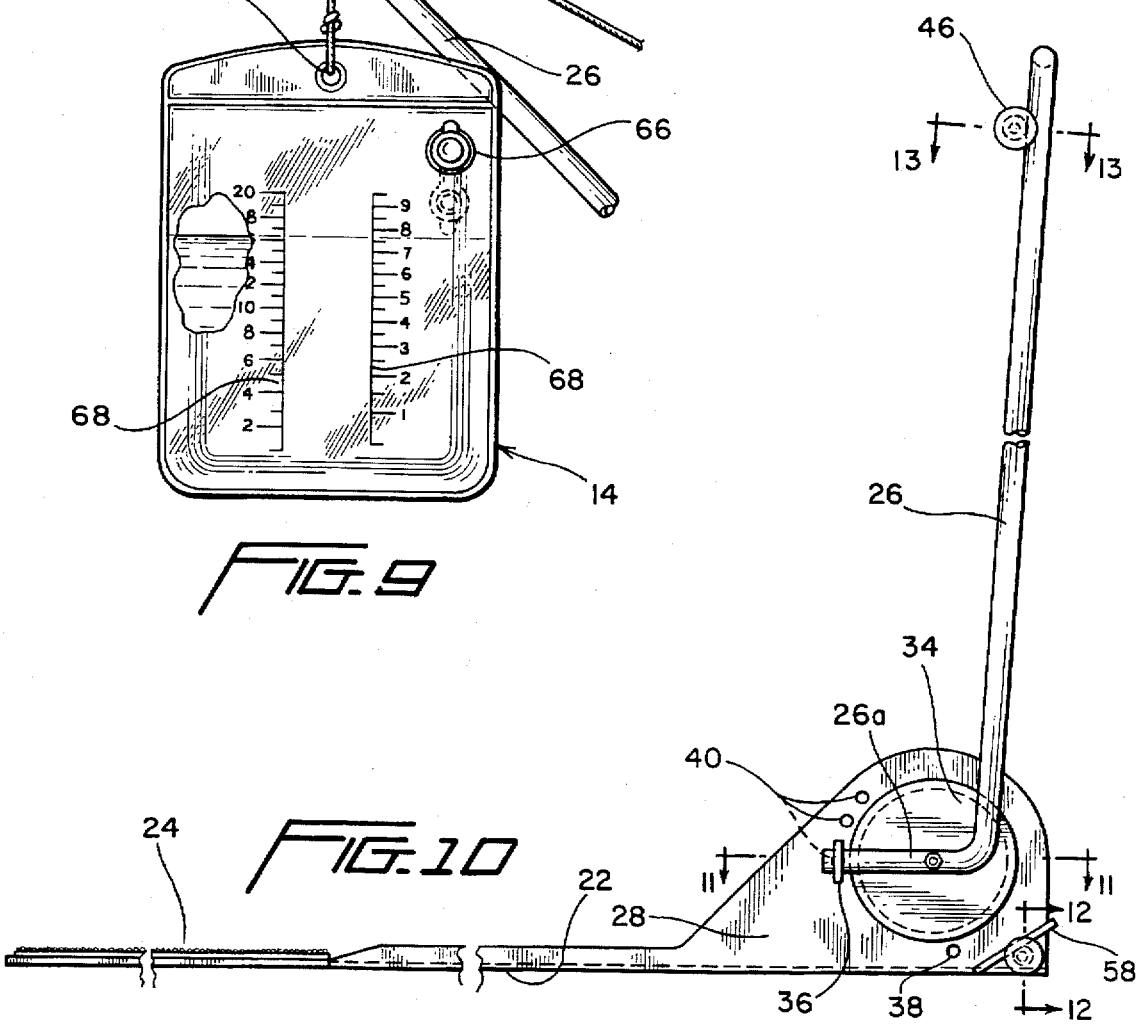
FIG. 10 is a side elevational view of a principal structural part of the device unfolded for use.
Figure 11:
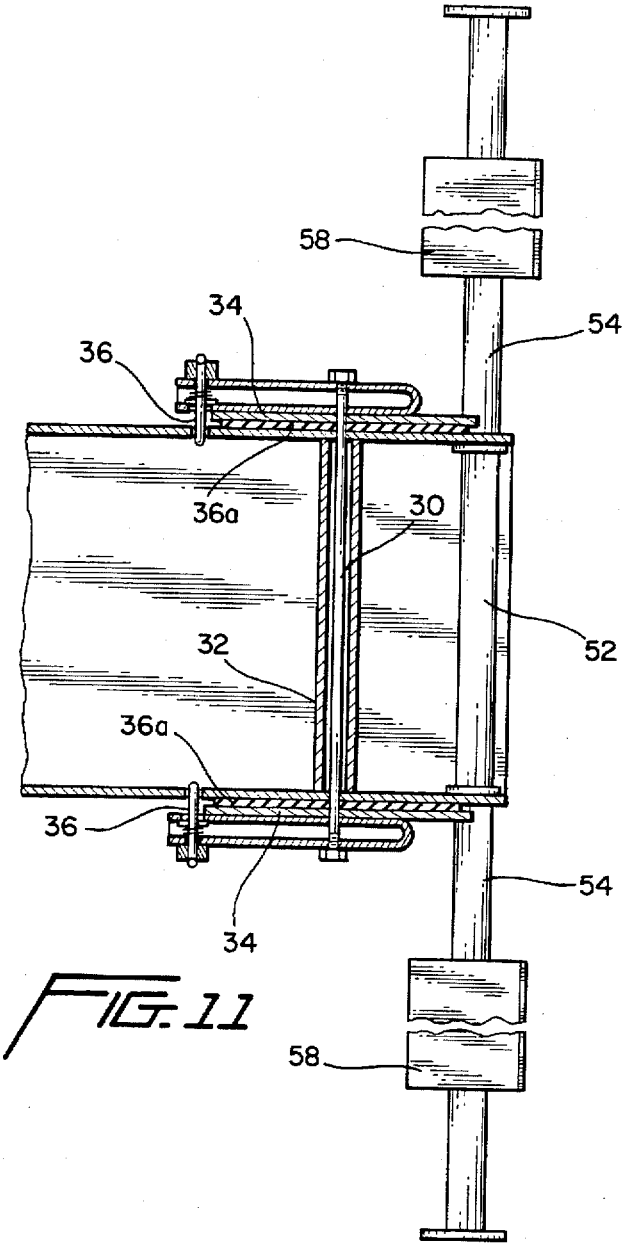
FIG. 11 is a sectional view on line 11—11 of FIG. 10.
Figure 13:
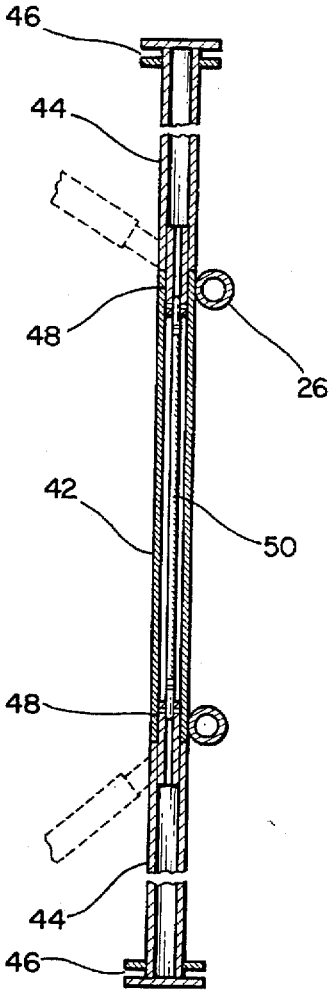
FIG. 13 is a sectional view on line 13—13 of FIG. 10.

Dealing firstly with the construction of frame assembly 10, this comprises an elongate base plate 22 having a strip 24 of loop or pile-type fabric at one end and a substantially arch-shaped support frame 26 pivotally attached to upright side plates 28 at the opposite end. Frame 26 can fold substantially flat against the base plate 22 for storage in bag 20 or can be elevated and releasably locked in selected upright positions for use. To this end, the lower ends of frame 26 are bent substantially at right angles (see FIGS. 10 and 11) to form extensions **26*a* which are pivotally connected to side plates 28 by an axle rod 30 extending through a tube 32 welded between the side plates. The extensions 26*a* are braced by circular metal support plates 34 which bear against rubber or like pads 36*a* on side plates 28. The end of each extension 26*a* carries a spring pin 36 which can be located in an aperture 38 in the corresponding side plate 28 when the frame 26 is folded flat for storage, or in one of a series of apertures 40 when the frame 26** is elevated for use, depending on the angle required for the frame.

Figure 14:
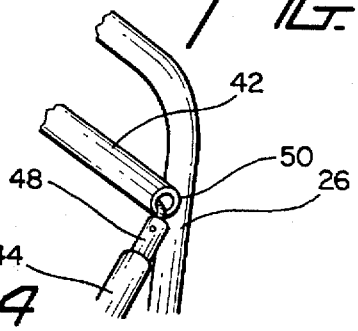
FIG. 14 is a perspective view of a part of the element shown in FIG. 10.
Figure 12:
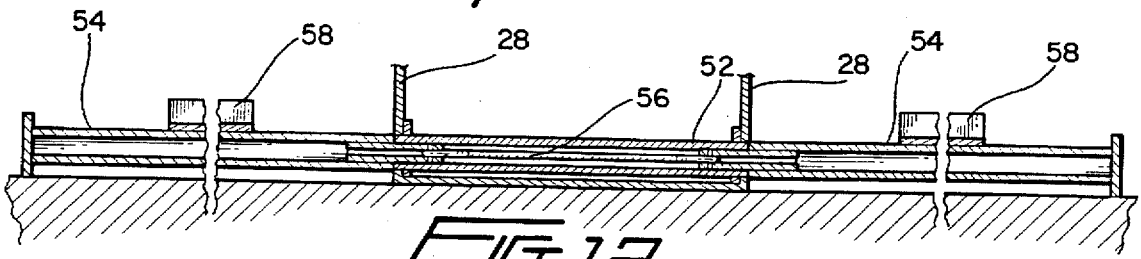
FIG. 12 is a sectional view on line 12—12 of FIG. 10.

At its upper or outer end frame 26 has a tubular cross-bar 42 into the ends of which fit a pair of extensions 44 having guides 46 at their outer ends for the cords 16. The extensions have reduced-diameter inner ends 48 that fit into the ends of cross-bar 42 and the extensions are joined together by a length of elastic cord 50 extending through cross-bar 42. The extensions can thus be removed from the cross-bar and folded in for storage (see FIG. 14) or inserted in the ends of the cross-bar 42 and snapped in place for use.

Another similar tubular cross-bar 52 is provided between the side plates 28 with snap-in extensions 54 again connected by an elastic cord 56 extending through the cross-bar. The extensions 54 in this case carry foot-rest plates 58. Again the extensions 54 can be removed and folded in for storage or inserted in cross-bar 52 for use.

Figure 6:
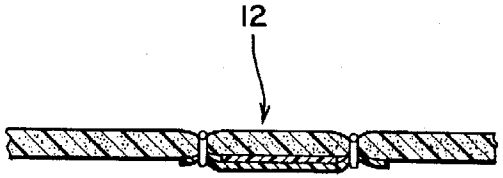
FIG. 6 is an enlarged sectional view on line 6—6 of FIG. 5.
Figure 5:
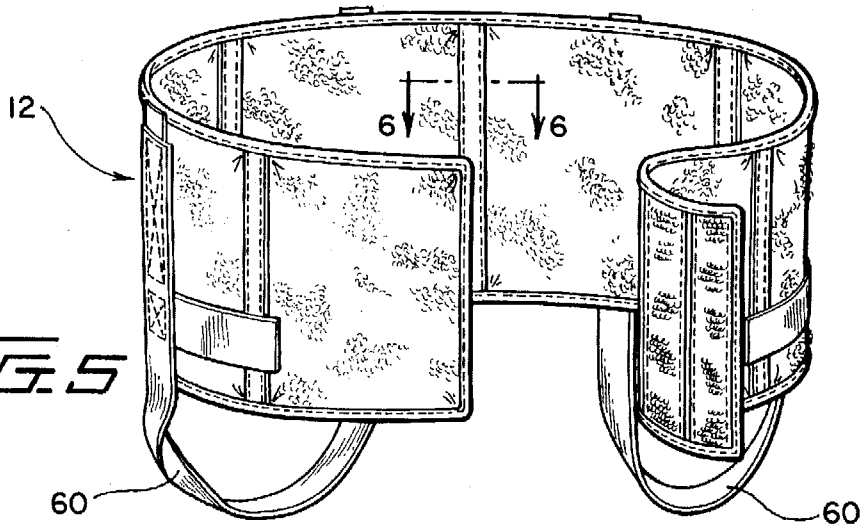
FIG. 5 is a perspective view of a pelvic traction belt forming part of the device.
Figure 7:
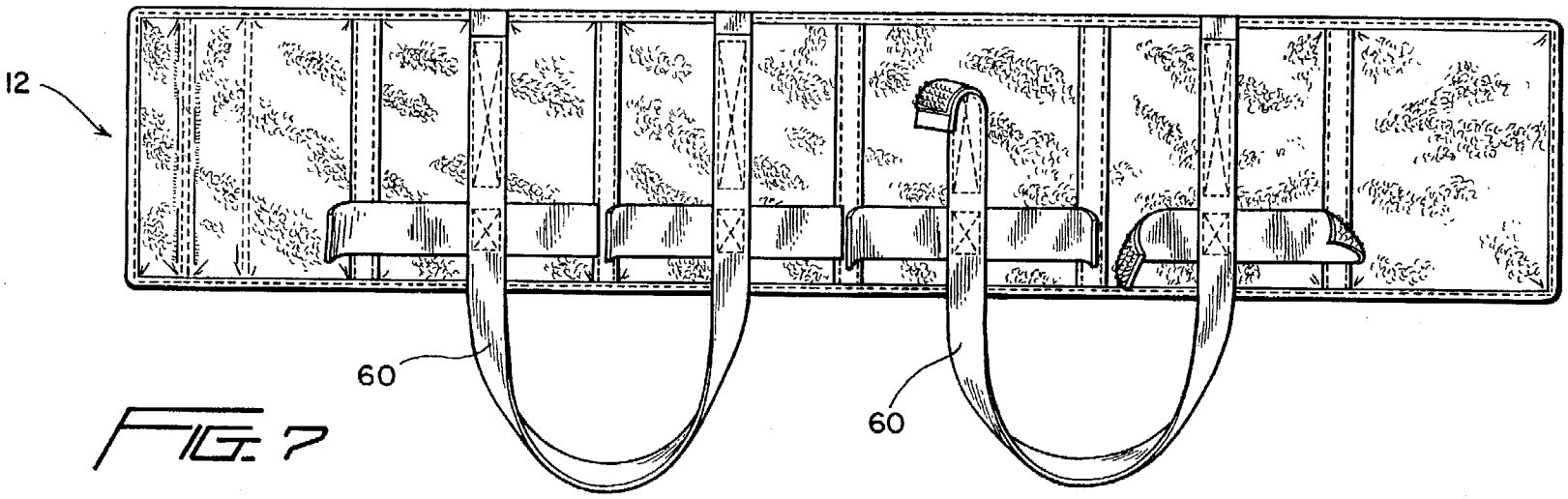
FIG. 7 is an opened-out view of the belt.
Figure 8:
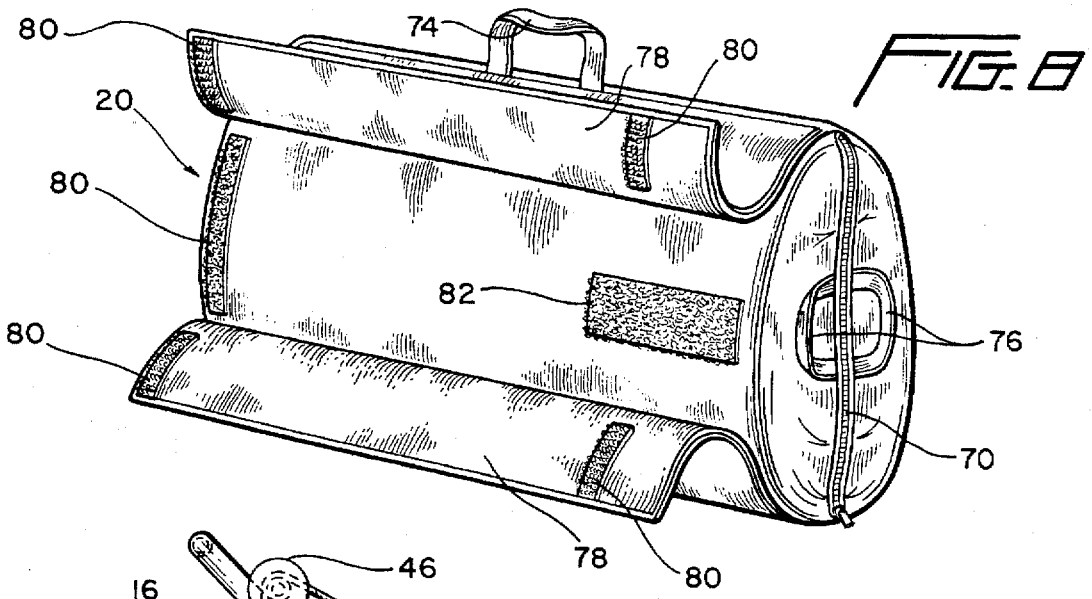
FIG. 8 is a perspective view of the carrying bag partially opened-out.
Figure 9:
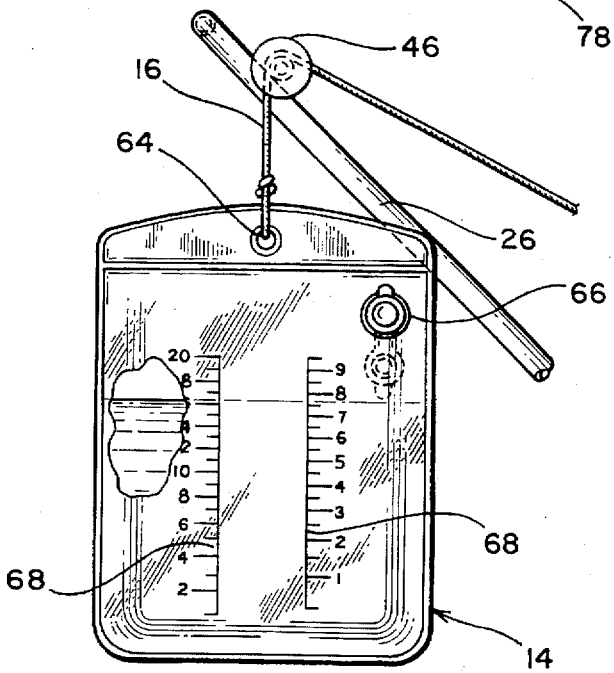
FIG. 9 is a side elevational view of parts of the device including a water bag.
Figure 15:
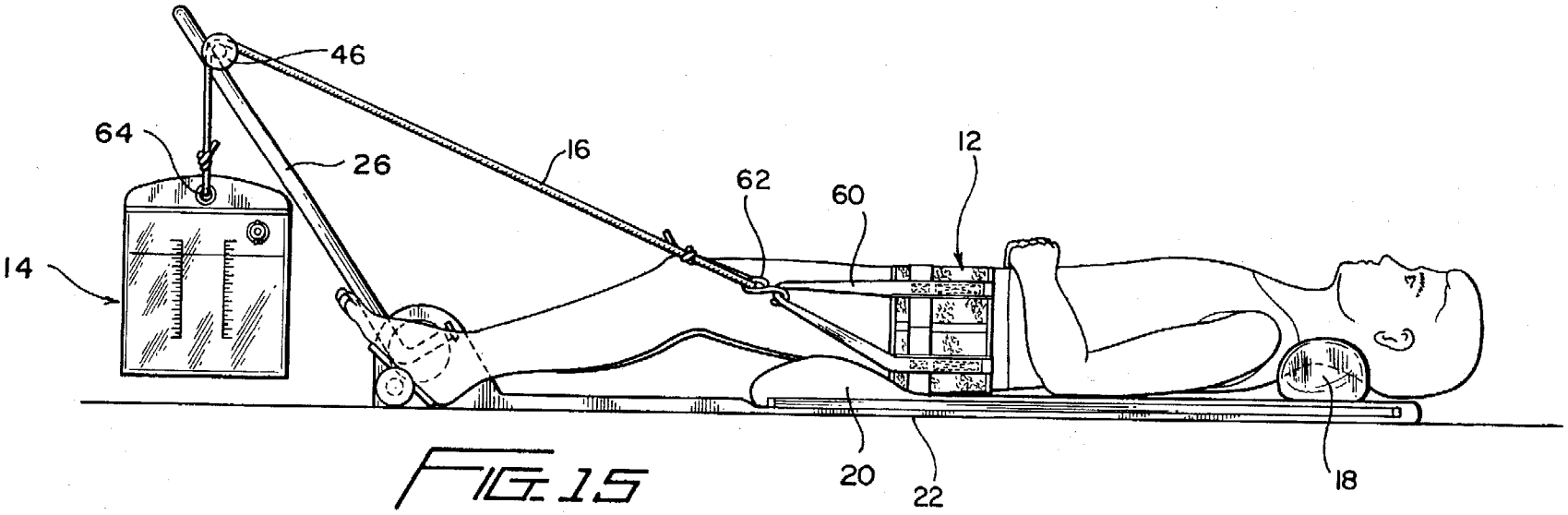
FIG. 15 is a side elevational view of the device shown in use on a floor.

The pelvic belt 12, see FIGS. 5–7, may be of any well-known form, possibly elasticized with an adjustable closure and a pair of adjustable side loops 60 to which the respective cords 16 can be attached by S-hooks 62, see FIGS. 3 and 15. When in use, the opposite end of each cord is tied to one of the water bags 14 with the cord being passed over a respective one of the guides 46 atop frame 26.

The water bags 14 are of a conventional plastic construction with a top eyelet 64 to receive a cord 16 and a filler valve and plug assembly 66. The bags may be provided with scales 68 to indicate the filling levels indicative of selected weights of water.

Figure 1:
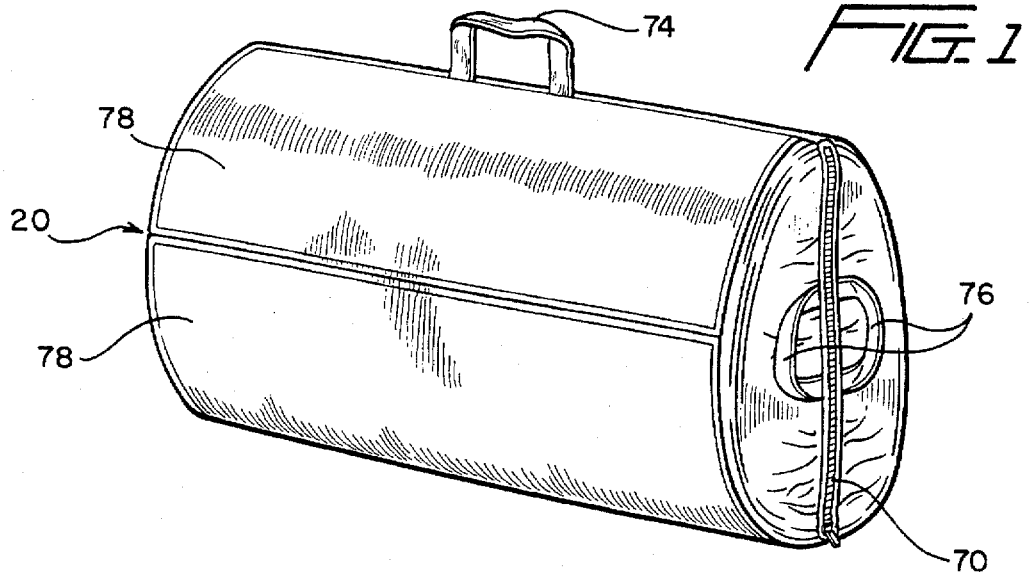
FIG. 1 is a perspective view of a carrying bag containing a portable traction device according to the invention.
Figure 2:
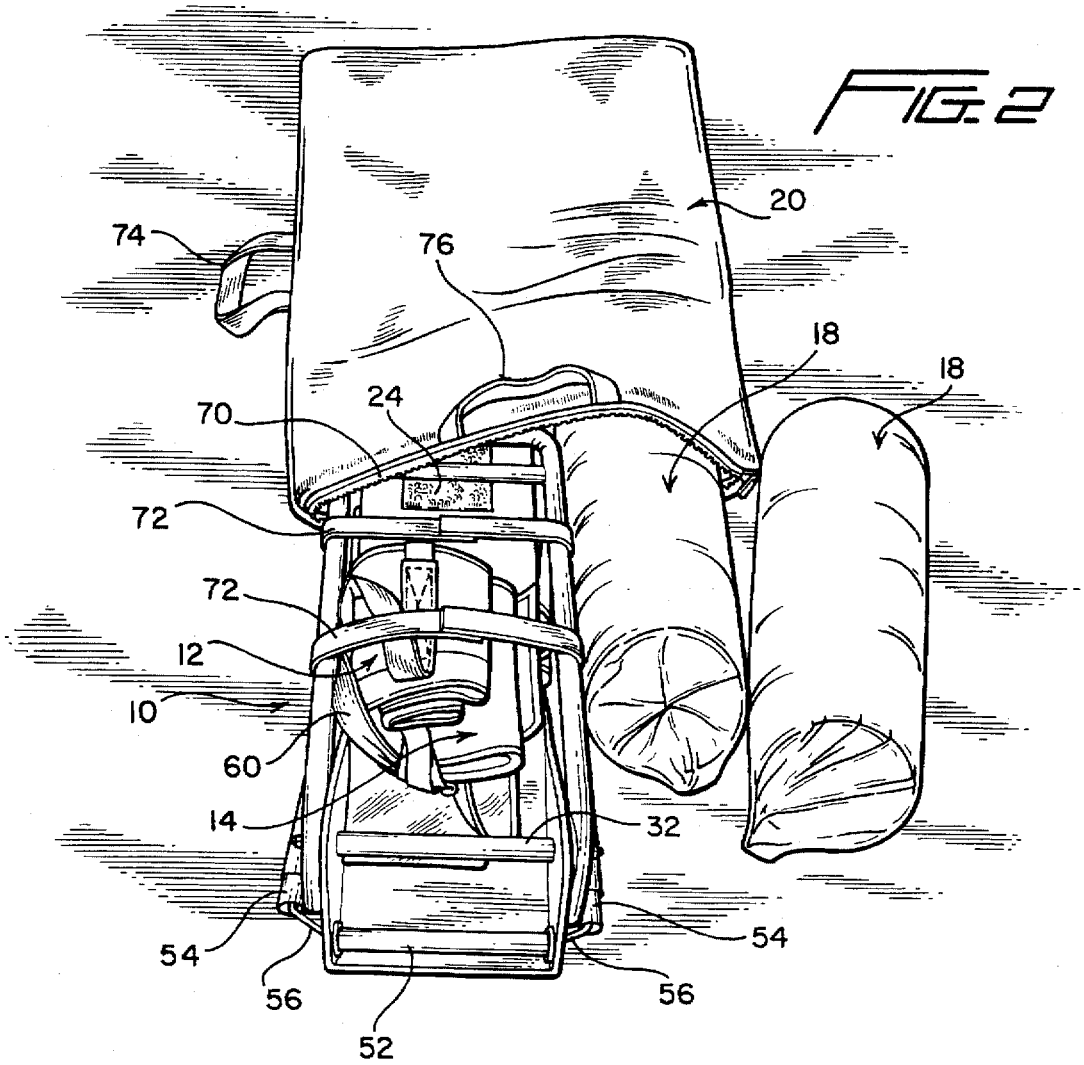
FIG. 2 is a perspective view showing components of the device partially removed from the carrying bag.
Figure 4:
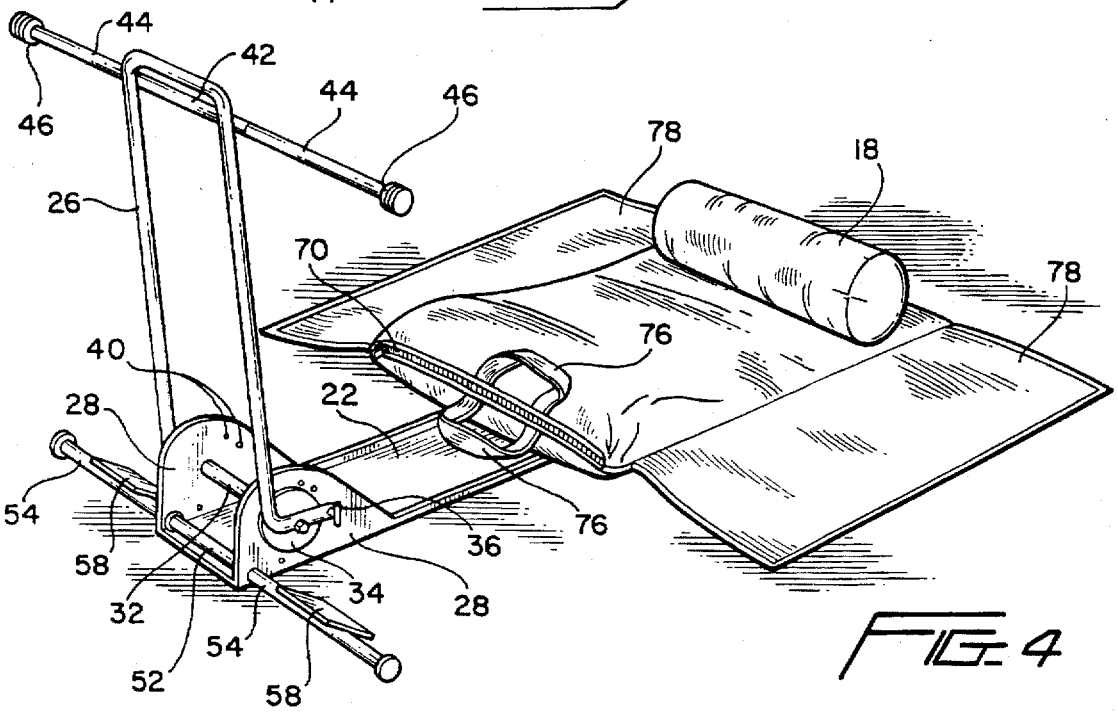
FIG. 4 is a perspective view of parts of the device readied for use.

Padded bag 20 has a zip closure 70 at one end and is sized to accommodate the remaining components of the device as shown in FIG. 2. In this regard, when frame assembly 10 is folded, the pelvic belt 12, water bags 14 (emptied of water) and cords 16 can be held in place for storage in bag 20 by encompassing releasable straps 72 which may have loop and pile-type end fasteners. Cushions 18 can be accommodated in bag 20 to one side of assembly 10. The carrying bag may have a side handle 74 and end handles 76. Also, on one side, the bag has fold-out panels 78 releasably secured by loop and pile strips 80. The panels cover a larger loop or pile strip 82 on one side of the bag which is complimentary to the strip 24 on base plate 22 and by which the bag can be attached to the base plate as shown in FIGS. 4 and 15. The length of strips 24 and 82 allow the bag 20 to be attached to the base plate in adjusted positions to suit a user's height.

It is a simple matter for a user to carry and unpack bag 20, then to assemble and use the device. As shown in FIGS. 2 and 3, with the bag unzipped and laid on the floor, cushions 18 are removed and the folded assembly 10 with attached belt, cords and water bags are slid out of bag 20. Straps 72 are removed, assembly 10 is unfolded and frame 26 is locked in a suitable upright position as determined by which of the holes 40 is used for locking pins 36. Then the extensions 44 and 54 are inserted in the ends of the respective cross-bars 42 and 52. Bag 20 is opened out as shown in FIG. 4 and attached to base plate 22 through the loop and pile-type fastener strips 24 and 82 being adjusted along the base plate to suit the user's height when lying on the bag with his or her feet on the foot plates 58 as shown in FIG. 15. One of the cushions 18 is placed inside the bag 20 to form a hip support and the other cushion 18 is placed on the distal end of the bag to form a neck support. Belt 12 is placed around the hips and water bags 14 filled with the required amount of water. The cords 16 are wound over guides 46, the user takes up position on the bag 20 and connects the ends of the cords to the straps 60 via the S-hooks 62, lifting the water bags 14 off the floor. Taking up the position shown in FIG. 15, traction is applied to the pelvic region through the weight of the water bags on belt 12. It is preferable that treatments be effected for periods of 30–60 minutes. After treatment, the device can be dismantled and stored in bag 20 by reversing the procedures described above.

Figure 16:
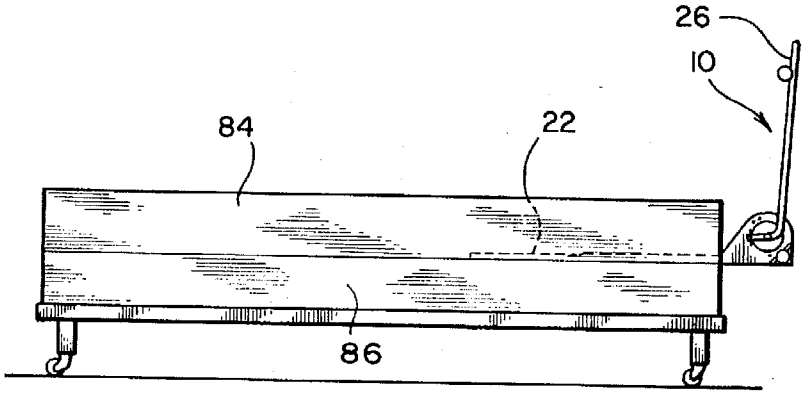
FIG. 16 is an elevational view showing how the device can be used on a bed which does not have head and foot boards.

It is also possible for the device to be used on a bed rather than on the floor. Thus, FIG. 16 shows base-plate 22 inserted between the mattress 84 and box-spring 86 of a bed without head and foot boards. The base-plate is inserted from the bottom end of the bed and assembly 10 is again stabilized by the weight of the user when lying on the bed over base plate 22. The device is used in the same manner as previously but without need of the bag 20 to form a padded base for the user.

Figure 17:
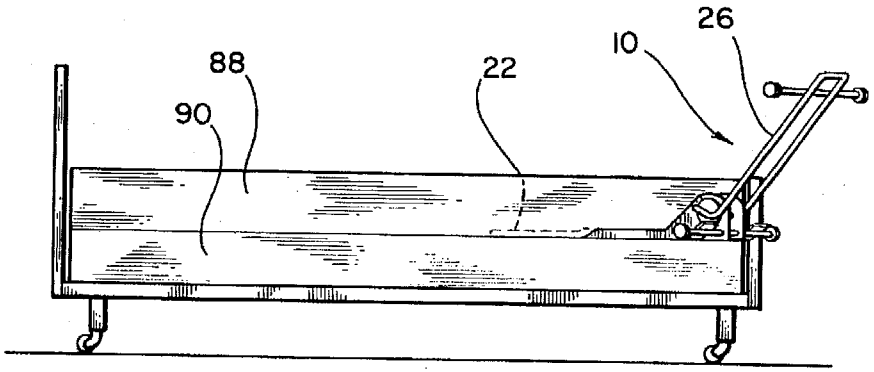
FIG. 17 is an elevational view showing how the device can be used on a bed having head and foot boards.

Finally, FIG. 17 shows how the assembly 10 can be used on a bed having head and foot boards. In this case base-plate 22 is inserted between the mattress 88 and the box springs 90 at a slanted orientation from one side of the bed and the user lies in a similar orientation across the bed.

The invention has been described herein in relation to its primary purpose of applying pelvic traction to the user. It will be readily understood, however, that the device can also be used for applying traction to other parts of the body. For example, with the user reversing his or her position on base-plate 22 and with the use of a head or like band for attachment of cords 16, the device can be used for the application of traction to the neck. It should also be understood that frame assembly 10 can, according to the present invention, be provided independently of the other components in a light-weight or other convenient carrier.

While only preferred embodiments of the invention have been described herein in detail, the invention is not limited thereby and modifications can be made within the scope of the attached claims.

I claim:

1. A portable traction device for applying traction to a selected part of a user's body, said device including a traction frame assembly comprising: an elongated base plate adapted to support a user during application of traction such that in use, the user's weight is effective in stabilizing the frame assembly, said base plate having two opposed ends; an elongate support frame pivotally connected to one end of the base plate for pivotal movements between a folded position, wherein the frame is substantially flat against the base plate and at least one elevate in-use position wherein the frame extends upwardly from the base plate; support means attached to the frame for supporting cord guides over which respective cords can be wound, each for attachment at one end to a traction belt or band worn by the user and at the other end to a traction weight, said support means comprising a cross-bar on the frame and a pair of extensions adapted to fit removably on opposite ends of the cross-bar and extend laterally outwardly from opposite sides of the frame, each extension being formed with a cord guide; and a padded storage and carrying bag for receipt of said assembly; and releasable attachment means on both the bag and base plate for releasably attaching the bag to the base plate to form a padded support sheet for the user on the base plate during application of traction.

2. A device as claimed in claim 1 wherein the cross-bar is tubular and wherein the device includes an elastic cord extending through the cross bar, said cord having opposite ends attached to the respective extensions.

3. A device as claimed as claim 1 which includes a further support means at said one end of the base plate for foot support plates on which the user's feet can be placed with the user positioned on the base plate facing said one end.

4. A device claimed in claim 3, wherein said further support means comprises a further cross bar extending across said one end of the base plate and a pair of further extensions adapted to fit releasably on opposite ends of the further cross-bar and extend laterally outwardly from opposite sides of the base plate, each further extension provided with a foot support plate.

5. A device as claimed in claim 4 wherein said further cross-bar is tubular and the device includes a further elastic cord extending through said further cross bar, said further cord having opposite ends attached to said further extensions.

6. A device as claimed in claim 1 including releasable locking means between the frame and the base plate for releasably locking the frame in said at least one elevated position.

7. A device as claimed in claim 6 wherein the releasable locking means comprises a locking pin on the frame adapted for releasable locking insertion in at least one aperture formed in the base plate.

8. A device as claimed in claim 1 further including a padded storage and carrying bag for said assembly and releasable attachment means on the bag and base plate for releasably attaching the bag to the base plate to form a padded support sheet for the user on the base plate during application of traction.

9. A device as claimed in claim 1 wherein the releasable attachment means comprises complimentary loop and pile-type fastener means on the bag and the base plate respectively.

10. A device as claimed in claim 1 including further components comprising a traction belt, cords for attachment each at one end to the traction belt, water bags forming weights for attachment to the opposite ends of the said cords and hip and neck cushions, all of said further components being receivable in said bag along with said traction frame assembly.

11. A portable traction device comprising: a padded storage transport bag and a folding traction frame assembly receivable in said bag, said folding traction frame assembly comprising: an elongate base plate adapted to support a user during application of traction to a selected part of the user's body such that in use, the user's weight stabilizes the frame assembly, said base plate having two opposite ends; a folding frame attached to one end of the base plate for unfolding into an upright position for application of traction; support means on the frame for supporting cord guides over which respective cords can be wound for attachment each at one end to a traction belt or band adapted to be worn by the user and at the other end to a traction weight, said traction weight applies traction to the user; and releasable attachment means on the base plate and bag for releasably attaching means on both the base plate and bag for releasably attaching the bag to the base plate in selected position to provide a padded sheet for the user on the base plate.

12. A device as claimed in claim 11 wherein the releasable attachment means comprises complimentary loop and pile-type fastener strips on the bag and the base plate respectively.

13. A device as claimed in claim 11 including further components comprising a traction belt, cords attachable each at one end to the traction belt, water bags attachable to opposite ends of the cords to form traction weights and neck and hip support cushions for the user, all said further components being receivable in said bag along with said traction frame assembly.

* * * * *